US012018678B2

(12) United States Patent
Broucke et al.

(10) Patent No.: US 12,018,678 B2
(45) Date of Patent: Jun. 25, 2024

(54) OIL-INJECTED MULTI-STAGE COMPRESSOR SYSTEM AND PROCEDURE FOR CONTROLLING SUCH A COMPRESSOR SYSTEM

(71) Applicant: ATLAS COPCO AIRPOWER, NAAMLOZE VENNOOTSCHAP, Wilrijk (BE)

(72) Inventors: Stijn Broucke, Wilrijk (BE); Pieter De Schamphelaere, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 365 days.

(21) Appl. No.: 17/273,422

(22) PCT Filed: Sep. 24, 2019

(86) PCT No.: PCT/IB2019/058062
§ 371 (c)(1),
(2) Date: Mar. 4, 2021

(87) PCT Pub. No.: WO2020/065504
PCT Pub. Date: Apr. 2, 2020

(65) Prior Publication Data

US 2021/0348606 A1 Nov. 11, 2021

(30) Foreign Application Priority Data

Sep. 25, 2018 (BE) ..... 2018/5657

(51) Int. Cl.
*F04C 11/00* (2006.01)
*F04C 3/00* (2006.01)
(Continued)

(52) U.S. Cl.
CPC ..... *F04C 11/001* (2013.01); *F04C 3/00* (2013.01); *F04C 15/0088* (2013.01); *F04C 15/0096* (2013.01); *F04C 23/02* (2013.01)

(58) Field of Classification Search
CPC ..... F04C 3/00; F04C 11/001; F04C 15/0088; F04C 15/0096; F04C 23/02
See application file for complete search history.

(56) References Cited

U.S. PATENT DOCUMENTS 3,759,052 A 9/1973 Inoue
4,439,997 A * 4/1984 Cantley ..... F25B 49/02 417/2
(Continued)

FOREIGN PATENT DOCUMENTS

CN 106489027 A 3/2017
EP 1 746 289 A1 1/2007
(Continued)

OTHER PUBLICATIONS

International Search Report of PCT/IB2019/058062 dated Jan. 23, 2020 [PCT/ISA/210].
(Continued)

*Primary Examiner* — Connor J Tremarche
(74) *Attorney, Agent, or Firm* — Sughrue Mion, PLLC

(57) ABSTRACT

An oil-injected multi-stage compressor system that comprises at least a low-pressure stage compressor element (2) with an inlet (4*a*) and an outlet (5*a*) and a high-pressure stage compressor element (3) with an inlet (4*b*) and an outlet (5*b*), whereby the outlet (5*a*) of the low-pressure stage compressor element (2) is connected to the inlet (4*b*) of the high-pressure stage compressor element (3) through a pipeline (6), characterized in that the compressor elements (2, 3) are provided with their own drive in the form of an electric motor (2*a*, 3*a*), whereby the compressor elements (2, 3) are connected to the electric motor (2*a*, 3*a*) either directly or
(Continued)

through a gearbox and that an intercooler (9) is provided in the aforementioned pipeline (6) between the low-pressure stage compressor element (2) and the high-pressure stage compressor element (3).

11 Claims, 1 Drawing Sheet

(51) Int. Cl.
*F04C 15/00* (2006.01)
*F04C 23/02* (2006.01)

(56) References Cited

U.S. PATENT DOCUMENTS 5,236,311 A * 8/1993 Lindstrom ..... F25B 31/002 417/254
5,547,019 A * 8/1996 Iacullo ..... F02B 29/0456 62/3.61
5,758,485 A * 6/1998 Frutschi ..... F01D 25/007 415/179
2004/0217180 A1* 11/2004 Lu ..... F04C 29/0007 236/44 C
2010/0286960 A1* 11/2010 Ringeisen ..... F02B 29/0418 702/183
2011/0023533 A1 2/2011 Shimazu
2011/0036110 A1 2/2011 Fujimoto et al.
2012/0023978 A1 2/2012 Chae et al.
2013/0061591 A1* 3/2013 Bove ..... F02C 7/143 60/645
2016/0076826 A1* 3/2016 Augenstein ..... F28F 9/22 165/110
2017/0268498 A1 9/2017 Kasahara

FOREIGN PATENT DOCUMENTS

JP 5041849 B2 10/2012
TW 200422523 A 11/2004
TW 201816317 A 5/2018
WO 2011/017783 A2 2/2011

OTHER PUBLICATIONS

Written Opinion of PCT/IB2019/058062 dated Jan. 23, 2020 [PCT/ISA/237].
Written Opinion of the International Preliminary Examining Authority of PCT/IB2019/058062 dated May 12, 2020 [PCT/IPEA/408].
International Preliminary Report on Patentability of PCT/IB2019/058062 dated Aug. 11, 2020 [PCT/IPEA/409].
Response To First Examination Report dated Jan. 19, 2023 in Indian Patent Application No. 202137014842.

* cited by examiner

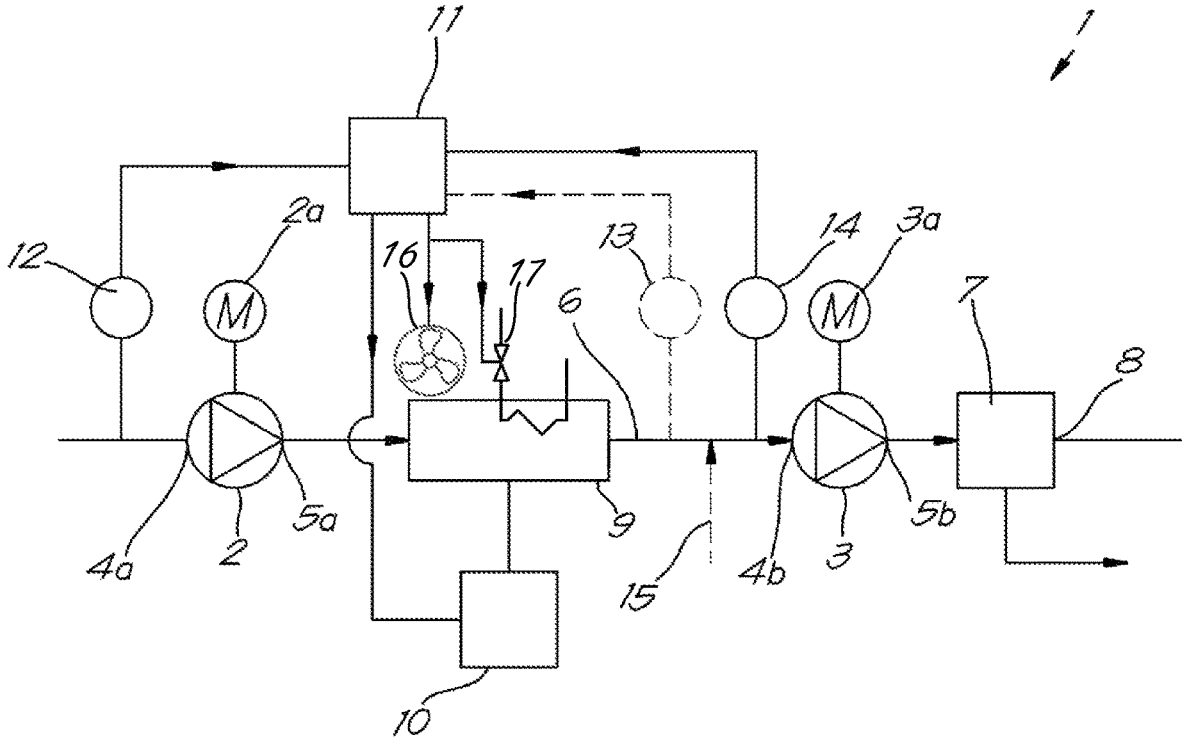
1
11
12
2a
M
16
17
6
13
14
3a
M
7
8
4a
2
5a
9
15
4b
3
5b
10

OIL-INJECTED MULTI-STAGE COMPRESSOR SYSTEM AND PROCEDURE FOR CONTROLLING SUCH A COMPRESSOR SYSTEM

CROSS REFERENCE TO RELATED APPLICATIONS

This application is a National Stage of International Application No. PCT/IB2019/058062, filed Sep. 24, 2019, claiming priority to Belgian Patent Application No. 2018/5657, filed Sep. 25, 2018.

The present invention pertains to an oil-injected multi-stage compressor system.

It is known that with oil-free compression, the compression of gas is traditionally carried out in two or more steps or "stages", whereby two or more compressor elements are placed in series, due to technical limitations, especially with regard to the maximum permissible exhaust temperature.

These technical limitations can be overcome by injecting a coolant such as water or oil into the compressor element, which allows for a single-stage compression.

Since the provision of multiple "stages" involves considerable complexity and additional costs, a single-stage compressor system with oil or water injection is currently the preferred option.

The fact that the maintenance of multi-stage compressor systems is more extensive and more complex also means that single-stage compressor systems are often still the preferred option.

Improved efficiency for the second and subsequent stages in a multi-stage compressor system would be an advantage that would outweigh the disadvantages described above. This improved efficiency would be possible by cooling the gas, which would reduce the consumption of the second and subsequent stages. This is not easy to achieve, however.

Multi-stage compressor systems already exist in which oil is injected between the two stages for cooling purposes, e.g. by means of an oil curtain in which the cooler oil lowers the temperature of the gas.

However, such a solution allows only limited cooling of the gas and therefore only provides limited improved efficiency compared to oil-free multi-stage compressor systems.

More oil is also added to the gas, which is not always desirable.

An oil-injected multi-stage compressor system could be applied whereby, for example, a cooler is provided between the first and second compressor element, which will actively extract heat from the gas after the first compression stage.

However, this is not done for the following reasons:

First of all, a pressure drop is expected in this cooler, which inevitably means a loss of efficiency.

The intercooling can also lead to condensate formation. The condensate must be prevented from entering the next compressor element at all times. Therefore, it is not possible to cool too deeply, to ensure that condensate can be avoided in all operating conditions. If condensate nevertheless occurs, it will end up in the oil and then in the bearings and other parts where this oil is used.

Moreover, this solution is naturally more complex and likely also more expensive than oil-free multi-stage compressor systems.

Due to all the disadvantages that go with that, it is possible, in principle, to make a very large gain in efficiency through cooling to ensure that the net result is favorable, whereby this gain can be limited by the occurrence of condensate.

Even if the problem of the condensate does not arise, it is assumed that it would still not be possible to cool sufficiently, simply because the temperature rise of the oil gas mixture after the first compression stage is not sufficient.

This invention aims at providing a solution to at least one of the aforementioned and other disadvantages.

The subject of the present invention is an oil-injected multi-stage compressor system, which includes at least a low-pressure stage compressor element with an inlet and an outlet and a high-pressure stage compressor element with an inlet and an outlet, whereby the outlet of the low-pressure stage compressor element is connected to the inlet of the high-pressure stage compressor element via a pipeline, with the characteristic that the compressor elements are provided with their own drive in the form of an electric motor, in which the compressor elements are connected to the electric motor either directly or by means of a gearbox, and that an intercooler is provided in the aforementioned pipeline between the low-pressure stage compressor element and the high-pressure stage compressor element, whereby the intercooler is

- an air-cooling system, which is adjustable by means of a fan, whereby the flow rate of the air can be controlled by adjusting the speed of the fan; or
- a water cooling unit, which is adjustable by means of a valve that can regulate the flow of the water, whereby the intercooler can also be regulated by changing the temperature of the air or water by means of a bypass pipeline and/or by screening a part of the intercooler so that the gas to be cooled is exposed to only a part of the intercooler.

It has been shown that cooling after the low-pressure stage can cause a much greater temperature drop of the gas than is described in the literature.

The temperature of an oil gas mixture is measured when measuring the temperature at the outlet of the low-pressure stage compressor element. The measured temperature will be lower than the actual temperature of the gas because of the wet bulb effect.

This means that the potential temperature drop of the gas to be achieved is much greater in reality than described in the literature.

This also means that the potential gain in efficiency by cooling are greater than previously assumed, so the aforementioned disadvantages do not outweigh the improved efficiency.

One advantage is that such an oil-injected multi-stage compressor system can achieve a higher performance than the known compressors without cooling or with an oil injection in the form of an oil curtain.

In accordance with a preferred characteristic of the invention, the intercooler is adjustable, whereby the compressor system is also equipped with a control unit or regulator to control or regulate the intercooler so that the temperature at the inlet of the high-pressure stage compressor element is above the dew point.

By keeping the temperature at the inlet of the high-pressure stage compressor element above the dew point, condensate can be avoided at this point.

Maximum cooling can be achieved at any time, without the risk of formation of condensate, by making the intercooler adjustable. It is therefore no longer necessary to use a worst-case scenario when determining the cooling capacity of the intercooler. As soon as the dew point rises and the intercooler cools the gas too much so that condensate forms, the intercooler can be regulated to cool the gas less to prevent the formation of condensate.

The intercooler can be made adjustable in various ways. A requirement for the adjustable intercooler is that the degree of cooling of the gas, or the temperature drop of the gas, can be changed. This can be done, for example, by changing the cooling capacity of the intercooler and/or by sending part of the gas through a bypass pipeline instead of through the intercooler.

It is known that the dew point is not a fixed value, but rather depends on various parameters such as the temperature, humidity, pressure of the gas, etc. There are several possibilities to determine this dew point.

The potential presence of condensate can be deduced from the dew point.

According to a preferred characteristic of the invention, the intercooler is equipped with a heat pump.

The advantage of this approach is that much deeper cooling is possible, so that at times when there is no risk of condensate forming after the intercooler, the maximum cooling capacity can be achieved, so that the high-pressure stage compressor element will be much more efficient.

The total gain in efficiency or performance will therefore be much higher.

The invention also involves a procedure for controlling an oil-injected multi-stage compressor system that comprises at least of a low-pressure stage compressor element with an inlet and an outlet and a high-pressure stage compressor element with an inlet and an outlet, whereby the outlet of the low-pressure stage compressor element is connected to the inlet of the high-pressure stage compressor element via a pipeline, with the characteristic that the compressor elements have their own drive system in the form of an electric motor, whereby the compressor elements are connected to the electric motor either directly or by means of a gearbox, and in the aforementioned pipeline between the low-pressure stage compressor element and the high-pressure stage compressor element there is an intercooler, whereby the intercooler is adjustable, whereby the compressor system is also equipped with a control unit or regulator to control or regulate the intercooler in such a way that the temperature at the inlet to the high-pressure stage compressor element is above the dew point, and with the characteristic that the procedure involves the following steps:

- calculating or determining the dew point at the inlet of the high-pressure stage compressor element;
- regulating the intercooler so that the temperature at the inlet of the high-pressure stage compressor element is above the dew point.

The advantages of such a procedure are of course similar to the above-mentioned advantages of the oil-injected multi-stage compressor system.

With the insight to better demonstrate the characteristics of the invention, a number of preferred variants of an oil-injected multi-stage compressor system according to the invention and a procedure applied therewith are described below, as an example without any restrictive character, with reference to the accompanying drawing in which:

FIG. 1 provides a schematic representation of an oil-injected multi-stage compressor system according to the invention.

The oil-injected multi-stage compressor system 1 shown in FIG. 1 comprises in this case two steps or "stages": a low-pressure stage with a low-pressure stage compressor element 2 and a high-pressure stage with a high-pressure stage compressor element 3.

Both compressor elements 2, 3 are, for example, screw compressor elements, but that is not a necessary requirement for the invention.

According to the invention, compressor elements 2, 3 are provided with their own drive in the form of electric motors 2*a* and 3*a* respectively, whereby in this case compressor elements 2, 3 are directly coupled to electric motors 2*a*, 3*a*. It is clear that compressor elements 2, 3 can be connected to electric motors 2*a*, 3*a* through a gearbox.

Compressor elements 2, 3 are also equipped with an oil circuit for the injection of oil into compressor elements 2, 3. For the sake of clarity, these oil circuits are not shown in the FIGURE.

Low-pressure stage compressor element 2 has an inlet 4*a* for gas and an outlet 5*a* for compressed gas.

This outlet 5*a* is connected to inlet 4*b* of the high-pressure stage compressor element 3 through a pipeline 6.

High-pressure stage compressor element 3 is also provided with an outlet 5*b*, where outlet 5*b* is connected to a liquid separator 7. It is possible for outlet 8 of liquid separator 7 to be connected to an aftercooler.

Intercooler 9 is included in the aforementioned pipeline 6 between low-pressure stage compressor element 2 and high-pressure stage compressor element 3.

In this case, the intercooler 9 is adjustable, but that is not necessary for the invention.

This intercooler 9 can be designed in different ways.

For example, intercooler 9 can be an air-cooling unit, which is adjustable by means of a fan 16, whereby the flow rate of the air can be controlled by adjusting the speed of the fan 16.

Alternatively, intercooler 9 can be a water cooler, which is adjustable by means of a valve 17 that can regulate the flow rate of the water.

It is also possible that intercooler 9 can be controlled by changing the temperature of the air or water.

It is also possible to provide a bypass pipeline that can divert part of the gas so that it can go directly from low-pressure stage compressor element 2 to high-pressure stage compressor element 3, without passing through intercooler 9.

It is also possible for a part of the intercooler 9 to be screened, e.g. with a plate or the like, so that not the entire intercooler is used. This means that the gas to be cooled is not exposed to the entire intercooler 9.

In this case, intercooler 9 is equipped with heat pump 10, but this is not necessary for the invention.

Heat pump 10 can also be adjustable, but this is not necessarily the case.

It will be possible to extract even more heat from the gas with the assistance of heat pump 10.

Compressor system 1 is also equipped with a control unit or regulator 11 for regulating or controlling intercooler 9. If heat pump 10 is adjustable, this control unit or regulator 11 will also be able to control heat pump 10.

In this case, sensor 12 is also provided. Sensor 12 is connected to the aforementioned control unit or regulator 11.

This concerns sensor 12, which can measure one or more environmental parameters at inlet 4*a* of low-pressure stage compressor element 2.

For example, sensor 12 can measure pressure, temperature and humidity.

It is not excluded that instead of or in addition to sensor 12, sensor 13 is provided at inlet 4*b* of the high-pressure stage compressor element 3. This is shown schematically in the FIGURE with a dotted line.

This sensor 13 can then measure the humidity at inlet 4*b*.

Furthermore, device 1 is equipped with sensor 14 at inlet 4*b* to measure the temperature.

Finally, it is not excluded for device 1 to be provided with an oil injection 15, so that oil can be injected into pipeline 6 downstream of the intercooler 9. This is shown schematically with a dotted line.

The operation of the oil-injected multi-stage compressor system 1 is very simple, as described below.

During operation, gas to be compressed, e.g. air, is sucked in through inlet 4*a* of low-pressure stage compressor element 2, and will undergo a first compression stage.

The partially compressed gas flows through pipeline 6 to intercooler 9 where it is cooled, and then to inlet 4*b* of high-pressure stage compressor element 3, where it undergoes a subsequent compression.

Oil is injected both in low-pressure stage 2 and in high-pressure stage compressor element 3, which will provide the lubrication and cooling for compressor elements 2, 3.

The compressed gas leaves high-pressure stage compressor element 3 through the outlet 5*b* and is led to oil separator 7.

The injected oil is separated and the compressed gas can then be transported to an aftercooler before being sent to the consumers.

To ensure that no condensate forms when the gas is cooled by intercooler 9, this intercooler 9 must be controlled in a suitable manner to accommodate changes in the environmental and/or drive parameters of compressor elements 2, 3.

For this purpose, the control unit or regulator 11 will regulate intercooler 9 so that the temperature at inlet 4*b* of high-pressure stage compressor element 3 is above the dew point. As stated previously, this means that no condensate will occur after intercooler 9 at inlet 4*b* of high-pressure stage compressor element 3.

In a first step, the dew point, i.e. the presence of condensate, is determined or calculated at inlet 4*b* of high-pressure stage compressor element 3. The dew point depends on different parameters and is in other words not a fixed value, but a variable.

There are several options or ways to determine the dew point.

In the case of FIG. 1, the dew point is determined by measuring the environmental parameters with the assistance of sensor 12.

For this purpose, the measured values from sensor 12 are transferred to the control unit or regulator 11, which calculates the dew point on the basis thereof.

If oil-injected multi-stage compressor system 1 is provided with humidity sensor 13 at inlet 4*b* of high-pressure stage compressor element 3, it is also possible to measure the humidity at inlet 4*b* to directly determine the dew point, or in other words, the presence of condensate. Here, humidity sensor 13 will also transmit the measured value to control unit 11.

Another alternative is to determine the dew point by monitoring the temperature at inlet 4*b* of high-pressure stage compressor element 3, e.g. by using temperature sensor 14 at inlet 4*b* of high-pressure stage compressor element 3 or another sensor specially designed thereto.

In this case, temperature sensor 14 will transmit the measured values of the temperature to inlet 4*b* to the control unit or regulator 11, which will monitor and evaluate the course of the measured temperatures to determine the dew point on the basis thereof.

When the dew point has been determined, the control unit or regulator 11 will regulate intercooler 9 so that the temperature at inlet 4*b* of high-pressure stage compressor element 3 is above the dew point.

For this purpose, the control unit or regulator 11 will request the temperature at inlet 4*b* through temperature sensor 14 and compare it with the established dew point.

Control unit 11 will allow intercooler 9 to cool more when the temperature at inlet 4*b* is higher than the dew point, as the temperature of the gas can drop even further without condensate occurring.

If the temperature is still higher than the dew point when intercooler 9 is already cooling to its maximum, control unit 11 will put heat pump 10 into operation.

It is also possible that heat pump 10 is always in operation and that regulation is only carried through intercooler 9.

It is also possible for heat pump 10 to be adjustable, so that when the dew point is lowered and the required cooling capacity therefore increases, the control unit 11 will allow the first intercooler 9 and then heat pump 10, or vice versa or both at the same time or alternately, to increase their cooling capacity.

If the temperature at inlet 4*b* is lower than or equal to the dew point, control unit 11 will reduce the cooling of intercooler 9 so that the temperature of the gas will rise, thereby avoiding the formation of condensate.

If heat pump 10 is also adjustable, control unit 11 can also first lower the cooling capacity of heat pump 10, or alternately lower the cooling capacity of intercooler 9 and heat pump 10.

In the event of a drop in the dew point, the control unit or regulator 11 may allow intercooler 9 to cool down again so that the temperature of the gas will drop again.

This always allows maximum cooling to be achieved without condensate occurring.

The performance of the high-pressure stage compressor element can be maximized by being able to cool optimally at all times.

If device 1 is provided with oil-injection 15, additional cooling of the gas can be obtained with this. In addition, the injected oil will provide additional lubrication for high-pressure stage compressor element 3.

This invention is by no means limited to the embodiments described by way of example and shown in the figures, but an oil-injected multi-stage compressor system according to the invention and a procedure applied thereto can be realized according to different variants, without going beyond the scope of the invention.

The invention claimed is:

1. An oil-injected multi-stage compressor system that comprises at least a low-pressure stage compressor element (2) with an inlet (4*a*) and an outlet (5*a*) and a high-pressure stage compressor element (3) with an inlet (4*b*) and an outlet (5*b*), whereby the outlet (5*a*) of the low-pressure stage compressor element (2) is connected to the inlet (4*b*) of the high-pressure stage compressor element (3) through a pipeline (6), wherein the compressor elements (2, 3) are provided with their own drive in the form of an electric motor (2*a*, 3*a*), whereby the compressor elements (2, 3) are connected to the electric motor (2*a*, 3*a*) either directly or through a gearbox and that an intercooler (9) is provided in the aforementioned pipeline (6) between the low-pressure stage compressor element (2) and the high-pressure stage compressor element (3), whereby the intercooler (9) is adjustable, whereby the compressor system (1) is also equipped with a control unit or regulator (11) to control or regulate the intercooler (9), so that the temperature at the inlet (4*b*) of the high-pressure stage compressor element (3) is above the dew point, whereby the intercooler (9) is an air-cooling system, which is adjustable by a fan, whereby the flow rate of the air can be controlled by adjusting the speed of the fan, whereby the intercooler (9) can additionally be regulated by changing the temperature of the air by a bypass pipeline that bypasses the intercooler.

2. The oil-injected multi-stage compressor system according to claim 1, wherein the compressor system (1) is provided with a sensor (12) that is connected to the control unit or regulator (11) to measure the environmental parameters, where the control unit or regulator (11) can determine or calculate the dew point based on the measurements of the sensor (12).

3. The oil-injected multi-stage compressor system according to claim 1, wherein the compressor system (1) is also provided with a humidity sensor (13) at the inlet (4*b*) of the high-pressure stage compressor element (3) that is connected to the control unit or regulator (11), which humidity sensor (13) can measure or determine the humidity, whereby the control unit or regulator (11) can determine or calculate the dew point on the basis of the measurements of the sensor (13).

4. The oil-injected multi-stage compressor system according to claim 1, wherein the compressor system (1) is also provided with a temperature sensor (14) at the inlet (4*b*) of the high-pressure stage compressor element (3) that is connected to the control unit or regulator (11), which temperature sensor (14) can measure or determine the temperature, whereby the control unit or regulator (11) is provided with an algorithm that allows determining the dew point based on the course of the temperature measured by the temperature sensor (14).

5. The oil-injected multi-stage compressor system according to claim 1, wherein the intercooler (9) is provided with a heat pump (10).

6. The oil-injected multi-stage compressor system according to claim 5, wherein the heat pump (10) is adjustable.

7. The oil-injected multi-stage compressor system according to claim 1, wherein oil is injected into the pipeline (6) that is downstream from the intercooler (9).

8. A procedure controlling an oil-injected multi-stage compressor system (1) comprising at least a low-pressure stage compressor element (2) with an inlet (4*a*) and an outlet (5*a*) and a high-pressure stage compressor element (3) with an inlet (4*b*) and an outlet (5*b*), whereby the outlet (5*a*) of the low-pressure stage compressor element (2) is connected to the inlet (4*b*) of the high-pressure stage compressor element (3) through a pipeline (6), wherein the compressor elements (2, 3) are provided with their own drive in the form of an electric motor (2*a*, 3*a*), whereby the compressor elements (2, 3) are connected either directly or by a gearbox to the electric motor (2*a*, 3*a*) and that an intercooler (9) is installed in the above pipeline (6) between the low-pressure stage compressor element (2) and the high-pressure stage compressor element (3), whereby this intercooler (9) is adjustable, whereby the compressor system (1) is also provided with a control unit or regulator (11) for controlling or regulating the intercooler (9) so that the temperature at the inlet (4*b*) of the high-pressure stage compressor element (3) is above the dew point, and that the procedure comprises the following steps:

calculating or determining the dew point at the inlet (4*b*) of the high-pressure stage compressor element (3); and additionally regulating the intercooler (9) so that the temperature at the inlet (4*b*) of the high-pressure stage compressor element (3) is above the dew point by at least partly bypassing the intercooler (9).

9. The procedure according to claim 8, wherein the calculation or determination of the dew point is done by measuring environmental parameters such as pressure, temperature and/or humidity.

10. The procedure according to claim 8, wherein the calculation or determination of the dew point is done by measuring the humidity at the inlet (4*b*) of the high-pressure stage compressor element (3).

11. The procedure according to claim 8, wherein the calculation or determination of the dew point is carried out by following the course of the temperature at the inlet (4*b*) of the high-pressure stage compressor element (3).

* * * * *